United States Patent [19]

Hayden

[11] Patent Number: 4,495,660

[45] Date of Patent: Jan. 29, 1985

[54] NECK GARMENT

[76] Inventor: Sharon M. Hayden, 14448 Garden, Livonia, Mich. 48154

[21] Appl. No.: 484,898

[22] Filed: Apr. 14, 1983

[51] Int. Cl.[3] ..... A41D 23/00

[52] U.S. Cl. ..... 2/91

[58] Field of Search ..... 2/91, 92, 101, 103, 2/133

[56] References Cited

U.S. PATENT DOCUMENTS

| | | | |
|---|---|---|---|
| 593,954 | 11/1897 | Way . | |
| 746,586 | 12/1903 | Schoch et al. . | |
| 837,143 | 11/1906 | Starr . | |
| 866,752 | 9/1907 | Way . | |
| 905,270 | 12/1908 | Abraham . | |
| 1,016,214 | 1/1912 | Curtis . | |
| 2,269,491 | 6/1940 | Snyder . | |
| 2,346,918 | 11/1942 | Herbranson . | |
| 2,688,136 | 9/1954 | Freedman | 2/133 |
| 3,449,766 | 4/1967 | Garber et al. . | |
| 3,479,667 | 8/1968 | Mehl . | |

FOREIGN PATENT DOCUMENTS

| | | | |
|---|---|---|---|
| 7747 | of 1910 | United Kingdom | 2/91 |
| 161125 | 4/1921 | United Kingdom | 2/91 |

*Primary Examiner*—Doris L. Troutman

*Attorney, Agent, or Firm*—Hauke and Patalidis

[57] ABSTRACT

A neck garment to be worn with an outer garment, such as a coat or sweater. The garment is provided with a portion for tucking beneath the shoulder portions of an outer garment and with a portion which can be worn in a rolled fashion, covering just the neck, or which can be unrolled to cover not only the neck but portions of the face as well. End-to-end fastening means are provided which permit putting the garment on, or taking it off, without pulling the garment over the head.

4 Claims, 7 Drawing Figures.

FIG. 2
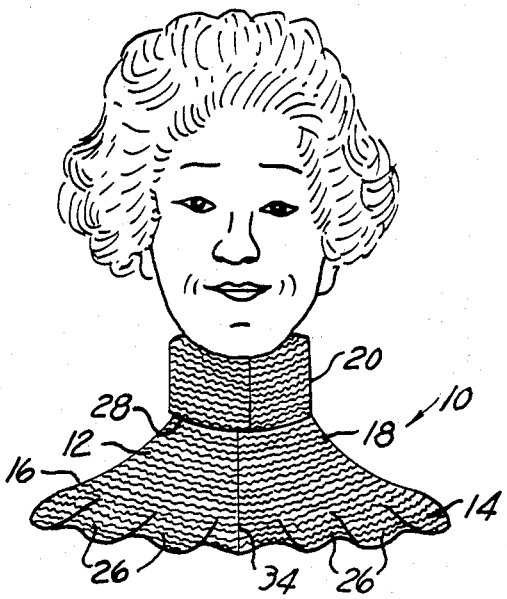
FIG. 1
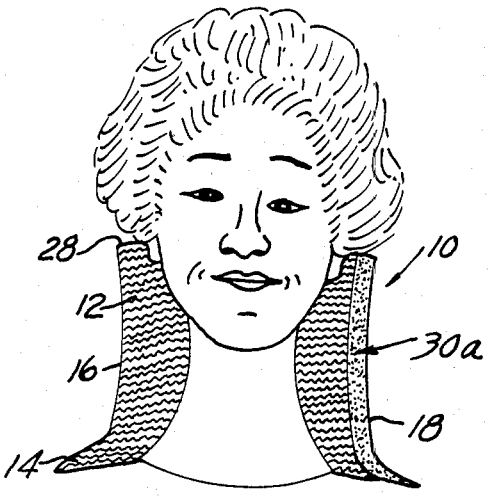
FIG. 3
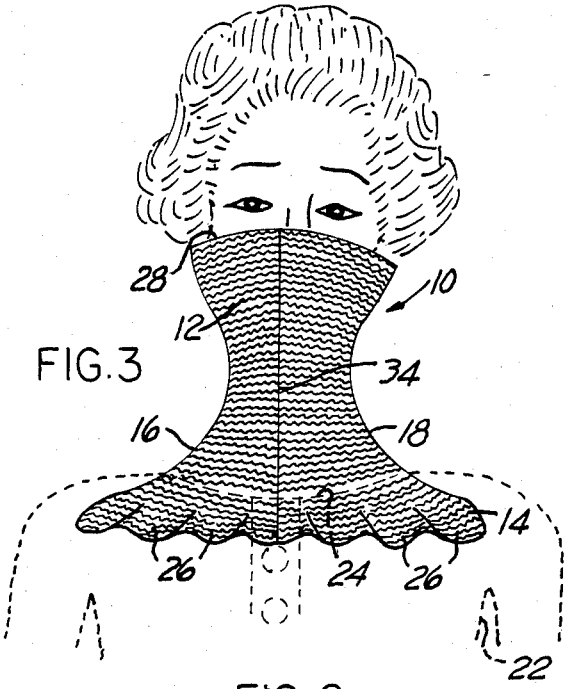
FIG. 4
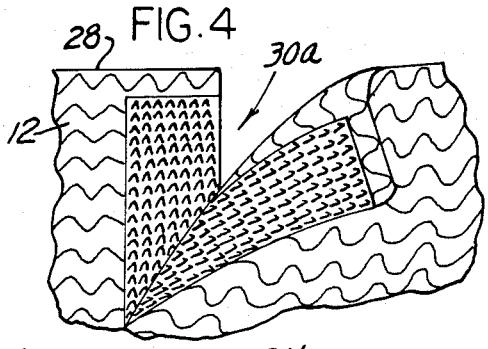
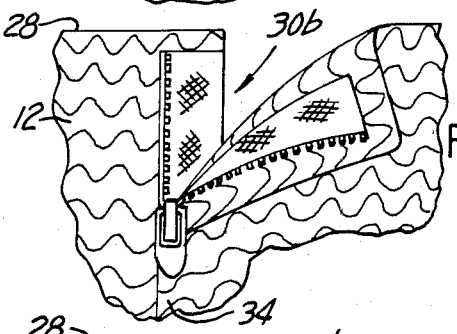
FIG. 5
FIG. 6
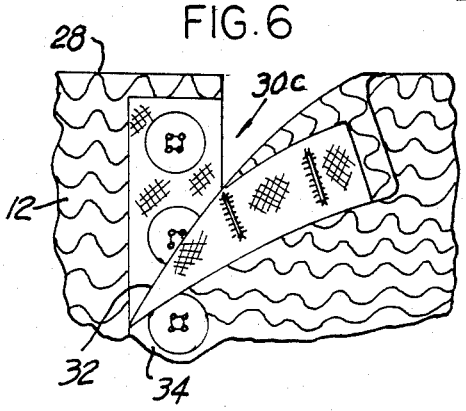
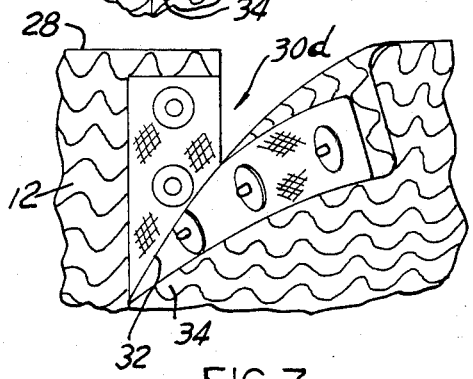
FIG. 7

NECK GARMENT

BACKGROUND OF THE INVENTION

The present invention relates to garments for protecting the head, neck, shoulder and chest areas of a person from cold drafts of air. More particularly, the invention relates to a garment especially suitable for wearing beneath an outer garment, such as a sweater or a topcoat.

A person wearing a topcoat, for example, during cold and blustery weather often requires further insulating garments to keep his or her face warm. Many topcoats also fail to shield the shoulders and chest of a wearer from chilling drafts due to leakages of air at the neck opening and frontal seam of the coat. Several configurations of scarves, dickeys and mufflers for wearing with an outer garment to enhance the over-all warmth of a person have been disclosed in the prior art, as shown, for example, at U.S. Pat. Nos. 593,954, 746,586, 837,143, 866,752, 905,270, 1,016,214, 2,269,491, 2,346,918, 3,449,766 and 3,479,667.

Each of these prior art garments is designed to protect the neck or chest regions of a wearer, or both. What is needed, however, is a garment which protects not only the neck and chest of a wearer, but which also effectively insulates the shoulders of a person and which, if desired, can also be worn with a portion of the garment covering the ear, mouth and nose of the wearer.

An improved garment of the type described should be relatively simple and inexpensive to manufacture. In addition, to prevent any particular hairstyle or makeup arrangement from being interfered with the garment should not require a person to pull the garment over his or her head when putting the garment on or taking it off.

SUMMARY OF THE INVENTION

The principal object of the present invention is to provide a garment which is simple and inexpensive to manufacture and which is effective, in co-operation with an outer garment such as a topcoat, to protect a wearer of the garment from drafts of cold air. A further object of the invention is to provide a garment which a person can put on or take off without pulling the garment over his or her head.

The invention accomplishes its objects by providing a garment formed of a single piece of pliable material. The garment has an apron portion for draping on the shoulders of the wearer and a muffler portion which can be turned over to form a collar or which can be extended to cover a portion of the wearer's head to protect his or her nose, mouth and ears.

These and other objects of the invention will become apparent to those skilled in the art, when the following description of an example of the best modes contemplated for practicing the invention is read in conjunction with the accompanying drawing wherein:

BRIEF DESCRIPTION OF THE DRAWING

FIG. 1 is a perspective view of an example of a garment according to the invention prior to being wrapped around the neck and shoulders of a person;

FIG. 2 is a perspective view of the garment being worn by a person wherein a muffler portion of the garment is turned-over to form a collar;

FIG. 3 is a view similar to FIG. 2 but showing the muffler portion of the garment extended over a portion of the head of the wearer, and further showing the garment fitted beneath a coat; and FIGS. 4–7 are examples of fastening means for the garment.

DETAILED DESCRIPTION OF THE PREFERRED EMBODIMENT

Referring now to the drawing, and more particularly to FIGS. 1–3 thereof, there is illustrated an example of an insulating garment 10 according to the invention. The insulating garment 10 is formed of a single piece of pliable material, preferably elastically stretchable, such as knitted wool, for example, having a scarf or muffler portion 12 and an integrally depending skirt or apron portion 14. As seen at FIG. 1, when the garment 10 is open, the longitudinal edges 16, 18 of the garment 10 are disposed substantially parallel to each other along the muffler portion 12 of the garment 10 and arcuately diverge away from each other along the apron portion 14.

When the insulating garment 10 is worn by a person, FIGS. 2 and 3, the longitudinal edges 16, 18 of the garment 10 are fastened together along substantially their entire length, as more fully explained hereafter, such that the garment 10 has a generally tubular configuration about the neck and shoulders of the wearer. More particularly, the apron portion 14 of the garment 10 is fastened around the shoulder and upper chest regions of the body with the muffler portion 12 of the garment 10 being turned down to form a collar 20, FIG. 2, or, if desired, with the muffler portion 12 being pulled up and stretched over the ears, nose and mouth of the wearer, FIG. 3.

At FIG. 3 the insulating garment 10 is shown being worn beneath a topcoat 22. The apron portion 14 of the garment 10 acts as a seal around the neck opening 24 of the topcoat 22 to prevent cold air drafts from leaking therethrough. A plurality of pleats 26 are disposed at regular intervals across a lateral surface of the apron portion 14 of the garment 10 to provide the apron portion 14 with increased thickness, thereby enabling it to better act as a seal. In addition, a strip of elastic material, not shown, may be provided across the top edge 28 of the muffler portion 12 of the garment 10 so that the muffler portion 12 has a tighter fit against the ears, nose and mouth of a wearer when the muffler portion 12 is in a pulled-up position.

It is readily apparent that the insulating garment 10 may be manufactured in a number of sizes. For effectiveness when the garment 10 is to be worn as shown at FIG. 3, the muffler portion 12 of the garment 10 is preferably made as long as the distance between the base of the neck and the midpoint of the head of a person expected to wear a particular size garment 10. The width of the apron portion 14 of the garment should be sufficient, after fastening the garment into a tubular shape, to permit each end of the apron portion 14 to extend through the neck opening of a coat and at least an inch under a shoulder of the coat.

FIGS. 4–7 illustrate examples of fastening means **30*a*–30*d* for the insulating garment 10, shown respectively as Velcro material 30*a*, FIG. 4, a zipper 30*b*, FIG. 5, button holes 30*c*, FIG. 6, and snaps 30*d*, FIG. 7. Each set of fastening means 30*a*–30*d* has two portions, with the respective portions of the fastening means 30*a*–30*d* being attached to, or formed in, opposite lateral surfaces of the garment 10. Each portion of each set of fastening means 30***a*–30*d* is further disposed proximate one of the longitudinal edges 16, 18 of the garment and extends across substantially the entire distance thereof. With the fastening means 30*a*–30*d* so arranged, the garment 10 has an end-to-end seam 32 which is hidden behind a portion of overlapping material 34 when the fastening means 30*a*–30*d* are engaged. It is a simple matter, therefore, for a person to close or open the fastening means 30*a*–30*d* along the end-to-end seam 32 when he or she desires to put on or take off the garment 10, without any need for pulling the garment over the head.

Having thus described the present invention by way of several examples of embodiments thereof, modifications of which will be apparent to those skilled in the art, what is claimed as new is as follows:

I claim:

1. A garment for insulating the head, neck, chest and shoulder areas of a person, said garment comprising a muffler portion and an integrally depending apron portion formed of a single piece of elastically stretchable material, said single piece of elastically stretchable material having two edges disposed substantially parallel to each other along said muffler portion of said garment and arcuately diverging away from each other along said apron portion of said garment when laid open flat, said garment further comprising a set of inter-engageable fastening means, wherein each portion of said set of fastening means is disposed proximate one of said edges of said piece of material and extends across substantially the entire distance thereof such that engagement of said fastening means holds said piece of material in a tubular configuration.

2. A garment according to claim 1 wherein said muffler portion is at least as long as the distance between the base of the neck and the midpoint of the head of a person wearing said garment.

3. A garment according to claim 1 wherein said garment is provided with a strip of elastic material along the top edge thereof.

4. A garment according to claim 1 wherein a plurality of pleats are longitudinally disposed at regular intervals across one lateral surface of said apron portion of said garment.

* * * * *